US009373247B2

(12) United States Patent
Li et al.

(10) Patent No.: US 9,373,247 B2
(45) Date of Patent: Jun. 21, 2016

(54) DISASTER MONITORING AND PRE-WARNING SYSTEM AND METHOD THEREOF

(71) Applicant: INSTITUTE FOR INFORMATION INDUSTRY, Taipei (TW)

(72) Inventors: Kuen-Han Li, Taipei (TW); Tien-Wei Huang, Taipei (TW); Ding-Jie Huang, Taipei (TW); Shu-Min Chuang, Taipei (TW); Shih-I Chen, New Taipei (TW); Chia-Nan Wang, Taipei (TW)

(73) Assignee: INSTITUTE FOR INFORMATION INDUSTRY, Taipei (TW)

( * ) Notice: Subject to any disclaimer, the term of this patent is extended or adjusted under 35 U.S.C. 154(b) by 0 days.

(21) Appl. No.: 14/454,730

(22) Filed: Aug. 8, 2014

(65) Prior Publication Data

US 2015/0379863 A1 Dec. 31, 2015

(30) Foreign Application Priority Data

Jun. 25, 2014 (TW) ..... 103121938 A

(51) Int. Cl.
*G08B 1/08* (2006.01)
*G08B 27/00* (2006.01)
*G08B 21/10* (2006.01)

(52) U.S. Cl.
CPC ..... *G08B 27/008* (2013.01); *G08B 21/10* (2013.01)

(58) Field of Classification Search
CPC ..... G08B 25/016; G08B 25/10; G08B 21/02; G08B 21/0446; H04W 24/08; H04W 72/085; H04W 72/082; H04W 24/02; H04W 88/06; G05B 23/02; G05B 23/027; G05B 9/03; G05B 19/0428; G05B 19/4184; G05B 2219/13; H01H 33/6606; H01H 75/04; H01H 33/6662; H01H 2033/6623; H01H 33/027; H01H 47/325
USPC ..... 340/3.43, 3.44, 539.11; 455/452.2, 455/67.13, 135, 160.1, 277.2; 700/292, 700/295; 370/332, 333
See application file for complete search history.

(56) References Cited

U.S. PATENT DOCUMENTS 7,705,721 B1 * 4/2010 Chen ..... G06F 11/30 340/518
2012/0112901 A1 * 5/2012 Chasko ..... G08B 21/10 340/517

FOREIGN PATENT DOCUMENTS

WO 2012015784 A1 2/2012

OTHER PUBLICATIONS

Fire Agency of the Ministry of Interior of Taiwan, R.O.C., Cloud Planning for Disaster Prevention and Rescue, Aug. 9, 2012(http://www.nfa.gov.tw/main/List.aspx?ID=&MenuID=745).
Chung-Hsin Lai et al., Investigation of Application of Short Message Service in Agricultural Information Communication System, 2012.
The 2nd examination report of the corresponding Taiwan application issued on Aug. 24, 2015.

* cited by examiner

*Primary Examiner* — George Bugg
*Assistant Examiner* — Sharmin Akhter
(74) *Attorney, Agent, or Firm* — CKC & Partners Co., Ltd.

(57) ABSTRACT

A disaster monitoring and pre-warning system comprises a disaster informing system, peer-to-peer wireless communication devices, a monitoring host and a pre-warning message issuing host. The disaster informing system transfers at least one first disaster information. The peer-to-peer wireless communication devices sense at least one disaster event to generate at least one second disaster information. The at least one second disaster information is transferred by a peer-to-peer technology. The monitoring host receives the at least one first disaster information and the at least one second disaster information to generate a first pre-warning information. The pre-warning message issuing host issues the first pre-warning information.

14 Claims, 7 Drawing Sheets

| | disaster event | sensor | time | latitude | longitude | data source | data content | pre-warning information |
|---|---|---|---|---|---|---|---|---|
| 1 | earthquake | earthquake sensor | 2014/03/03 08:20:30 | +24° 59' 21.6" | +121° 19' 5.4" | oniste | earthquake measuring 4 on the Richter scale that will happen after 4 second | yes |

Fig. 4A

| | disaster event | sensor | time | latitude | longitude | data source | data content | pre-warning information |
|---|---|---|---|---|---|---|---|---|
| 1 | flood disaster | rainfall sensor | 2014/03/01 09:20:30 | +24° 58' 45.6" | +121° 19' 36.59" | oniste | 50mm | no |
| 2 | flood disaster | water flow sensor | 2014/03/03 09:21:30 | +24° 58' 45.6" | +121° 19' 36.59" | oniste | $100m^3/hr$ | no |
| 3 | flood disaster | water stage sensor | 2014/03/03 09:22:30 | +24° 58' 45.6" | +121° 19' 36.59" | oniste | 20cm | no |

Fig. 4B

| | disaster event | sensor | latitude | longitude | data source | data content | pre-warning information |
|---|---|---|---|---|---|---|---|
| 1 | flood disaster | rainfall sensor | +24° 58' 45.6" | +121° 19' 36.59" | oniste | 15mm | mild (1) |
| 2 | flood disaster | water flow sensor | +24° 58' 45.6" | +121° 19' 36.59" | oniste | $120m^3/hr$ | middle (2) |
| 3 | flood disaster | water stage sensor | +24° 58' 45.6" | +121° 19' 36.59" | oniste | 60cm | high (3) |

Fig. 4C

| disaster event | severity | pre-warning | reliability |
|---|---|---|---|
| earthquake | high (3) | pre-warning (3) | confirmed by an expert (3) |
| flood disaster | middle (2) | diaster happening (2) | confirmed by a computer (2) |
| earthguake | mild (1) | diaster over (1) | not confirmed (1) |

Fig. 6

DISASTER MONITORING AND PRE-WARNING SYSTEM AND METHOD THEREOF

RELATED APPLICATIONS

This application claims priority to Taiwan Application Serial Number 103121938, filed Jun. 25, 2014, the entirety of which is herein incorporated by reference.

BACKGROUND

1. Field of Invention

The invention relates to a monitoring and pre-warning system, and particularly relates to a monitoring and pre-warning system and method that may integrate heterogeneous network for disaster prevention.

2. Description of Related Art

In typical, there are two types of disaster prevention system. One is an onsite disaster prevention system, and the other is a regional disaster prevention system. The onsite disaster prevention system is used to process a rapid disaster information report for a fixed point, such as a school Each detecting apparatus in the onsite disaster prevention system senses the disaster information to generate a corresponding warning individual. In other words, it is not necessary to integrate different disaster information from different detecting apparatus to generate the warning information. Therefore, the onsite disaster prevention system may generate a pre-warning information immediately for a fixed point. However, because the onsite disaster prevention system only processes a rapid disaster information report for a fixed point, the disaster information is not transferred to other region when the disaster happens. The other region may not use this disaster information to improve the reliability of issuing pre-warning information.

On the other hand, the regional disaster prevention system may receive and integrate disaster information form different fixed points to generate more reliable pre-warning information. In typical, the regional disaster prevention system uses a public network or buries another communication lines to form a communication connection in a region. The building cost and maintenance fee is expensive. Moreover, such communication connection needs base stations to transfer the disaster information. Therefore, once one of the base stations is out of order, the communication connection will be cut off to make the disaster information be not transferred in the region, which causes the regional disaster prevention system be failure.

SUMMARY

Accordingly, the present invention provides a disaster monitoring and pre-warning system that may integrate heterogeneous network to provide a complete informing disaster information platform to improve the pre-warning efficiency.

Accordingly, the present invention provides a disaster monitoring and pre-warning system comprises a disaster informing system, peer-to-peer wireless communication devices, a monitoring host and a pre-warning message issuing host. The disaster informing system transfers at least one first disaster information. The peer-to-peer wireless communication devices sense at least one disaster event to generate at least one second disaster information. The at least one second disaster information is transferred by a peer-to-peer technology. The monitoring host receives the at least one first disaster information and the at least one second disaster information to generate a first pre-warning information. The pre-warning message issuing host issues the first pre-warning information.

The present invention also provides a disaster monitoring and pre-warning method. First, a disaster information is received. The disaster information is from a disaster informing system or a plurality of peer-to-peer wireless communication devices. Next, a determination step is performed to determine whether or not the disaster information is a pre-warning information. When the disaster information is not a pre-warning information, a data of the disaster information is compared with a pre-warning threshold value. When the data of the disaster information is larger than the pre-warning threshold value, a determination step is performed to determine whether or not a pre-warning information about the disaster information has been issued. When the pre-warning information about the disaster information has not been issued, the pre-warning information about the disaster information is issued.

Accordingly, an onsite disaster information is transferred in a WMN structure. The WMN structure provides multiple communication paths between a WMN device and another WMN device. Therefore, even though a WMN device in a communication path is failure, the packet original transferred in the communication path may be changed to transfer through another communication path. Therefore, the communication stability may be improved. Moreover, the monitoring host may integrate the regional disaster information into onsite disaster information to provide a complete disaster information.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows:

FIG. 4A and FIG. 4B illustrate a record table of a disaster event according to an embodiment of the invention.

FIG. 4C illustrates a record table of a pre-warning threshold value according to an embodiment of the invention.

FIG. 6 illustrates a classification table of a pre-warning signal issued by a monitoring host according to an embodiment of the invention.

DETAILED DESCRIPTION

Figure 1:
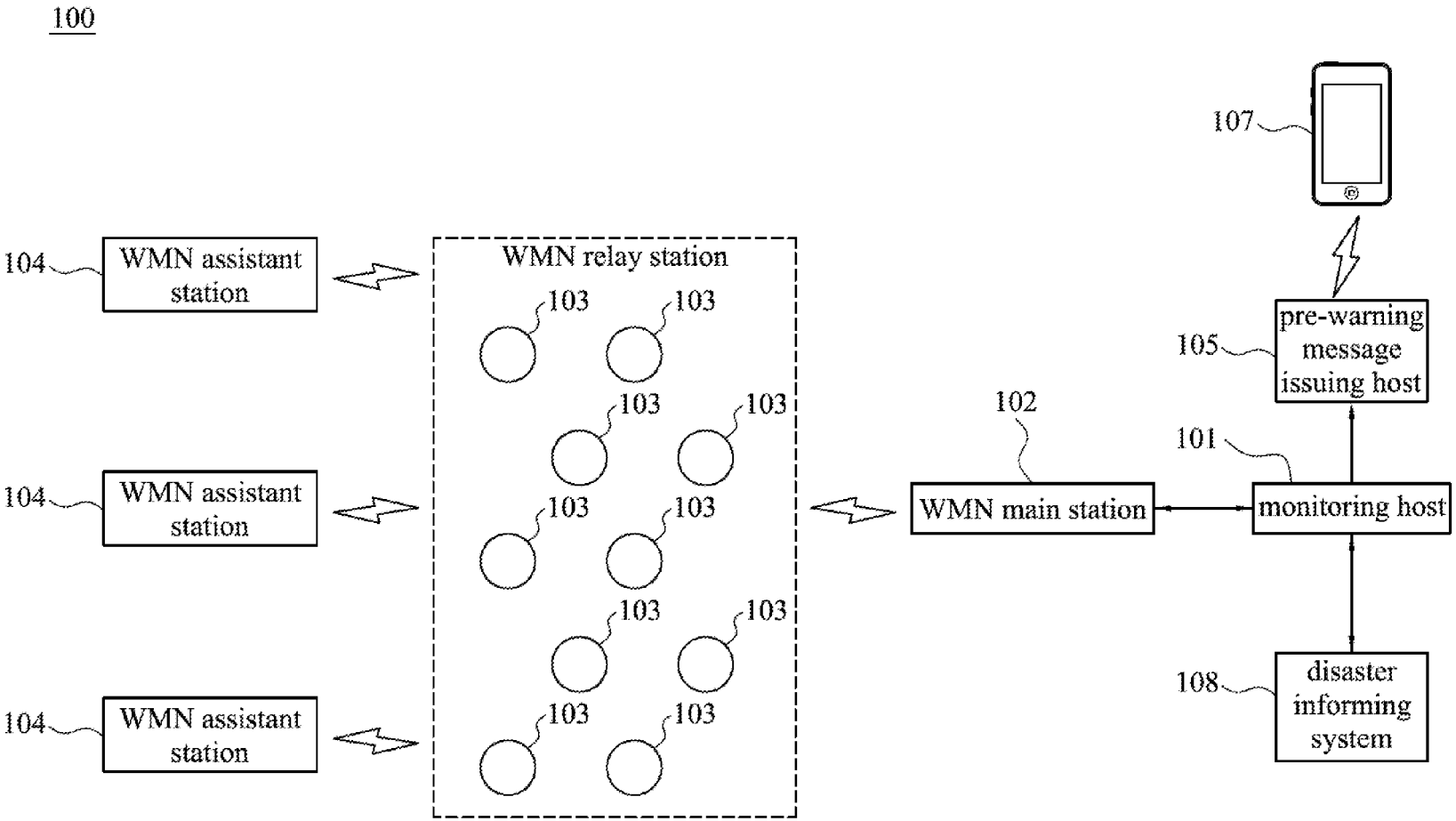
FIG. 1 illustrates a schematic diagram of a disaster monitoring and pre-warning system according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

The disaster information is usually not transferred to a predetermined position because the communication system is destroyed by the disaster. Therefore, for avoiding the foregoing problem, this present invention utilizes the telecom network to transfer the disaster information for the remote monitoring terminals and utilizes the peer-to-peer wireless transmission technology to transfer the disaster information to adjacent region through the Wireless Mesh Network (WMN) in real time for the sensing and warning terminals. Therefore, when a disaster event happens, even though the base station is out of work, a WMN is still formed among the sensing and warning terminals to achieve pre-warning function in real time. Many WMN devices are disposed in a WMN. Each WMN device has receiving and transferring information function to wireless communicate with other WMN device to transfer the packet. Thus, the communication between the WMN devices and between the WMN device and the network is changed from wired to wireless to form WMN structure, which provides multiple communication paths from a WMN device to another WMN device. In other words, even though a WMN device in the WMN structure is out of work, a WMN device still can communicate with another WMN device through other communication paths without the failed WMN device. Thus, the communication interruption situation because of the WMN device out of work is not happened. Accordingly, when an information is transferred to a WMN device, this WMN device may select another WMN device to transfer this information. Such information transmission process is continuously performed until this information is transferred to the wireless gateway. Then, the wireless gateway transfers this information to the network.

FIG. 1 illustrates a schematic diagram of a disaster monitoring and pre-warning system according to an embodiment of the invention. The disaster monitoring and pre-warning system 100 comprises a monitoring host 101, a plurality of peer-to-peer wireless communication devices, a pre-warning message issuing host 105 and a disaster informing system 108. In an embodiment, the pre-warning message issuing host 105 is a short message service host. The disaster informing system 108 for informing a disaster event is a National disaster informing system, such as the Central Weather Bureau or the Water Resource Agency. The disaster event, for example, is an earthquake disaster, a flood disaster or a weather disaster from the Central Weather Bureau, or the Water Resource Agency. The peer-to-peer wireless communication devices transfer information by peer-to-peer technology. In an embodiment, the peer-to-peer wireless communication devices are WMN devices. The WMN devices comprise a WMN main station 102, a plurality of WMN relay stations 103 and a plurality of WMN assistant stations 104. The WMN assistant stations 104 are the terminals of the WMN. Therefore, it is not necessary for the WMN assistant stations 104 to pass disaster information to another WMN device. The WMN relay stations 103 are disposed between the WMN main station 102 and the WMN assistant stations 104. Therefore, the WMN relay stations 103 are responsible for passing the disaster information. That is, when the WMN assistant stations 104 sense a disaster event and issue a disaster information to the WMN relay stations 103, the WMN relay stations 103 pass the disaster information to the WMN main station 102 to inform the monitoring host 101. On the other hand, the monitoring host 101 receives the disaster information not only from the WMN main station 102 but also from the disaster informing system 108. Then, the disaster information is transferred to the pre-warning message issuing host 105 from the monitoring host 101 to transfer to the mobile phone 107 to inform the public.

Moreover, a sensing module or a warning module is selectively disposed in each WMN device, such as the WMN main station 102, each of the WMN relay stations 103 and each of the WMN assistant stations 104, to serve as a sensing terminal or a warning terminal. The sensing module is a rainfall sensor, a water stage sensor or an earthquake sensor. The warning module is a speaker. The WMN main station 102 is a base station of the WMN. The WMN main station 102 receives disaster information sensed by the WMN assistant stations 104 or the WMN relay stations 103 through the WMN relay stations 103. That is, the disaster information sensed by each WMN assistant station 104 and each WMN relay station 103 is transferred to the WMN main station 102 through other WMN relay stations 103 to upload the monitoring host 101. Then, the monitoring host 101 sends this disaster information to the pre-warning message issuing host 105 that generates pre-warning message to the mobile phone 107 to inform the public. Moreover, the WMN main station 102 has a two-way information flow interaction function. That is, the WMN main station 102 not only may transfer the disaster information sensed by the WMN assistant stations 104 and WMN relay stations 103 to the monitoring host 101 but also may require the monitoring host 101 the disaster information transferred from the disaster informing system 108. Then, the WMN main station 102 may transfer the disaster information from the disaster informing system 108 to the WMN assistant stations 104 and WMN relay stations 103. The WMN assistant stations 104 and WMN relay stations may warn the public through the warning module disposed thereon. In other words, the WMN assistant stations 104 and the WMN relay stations 103 are a sensing terminal and a warning terminal, which improves the pre-warning function. On the other hand, for improving the communication quality, the WMN assistant stations 104 and the WMN relay stations 103 are disposed outside of a house and the WMN main station 102 is disposed in a house for operators to manage in convenience.

Figure 2:
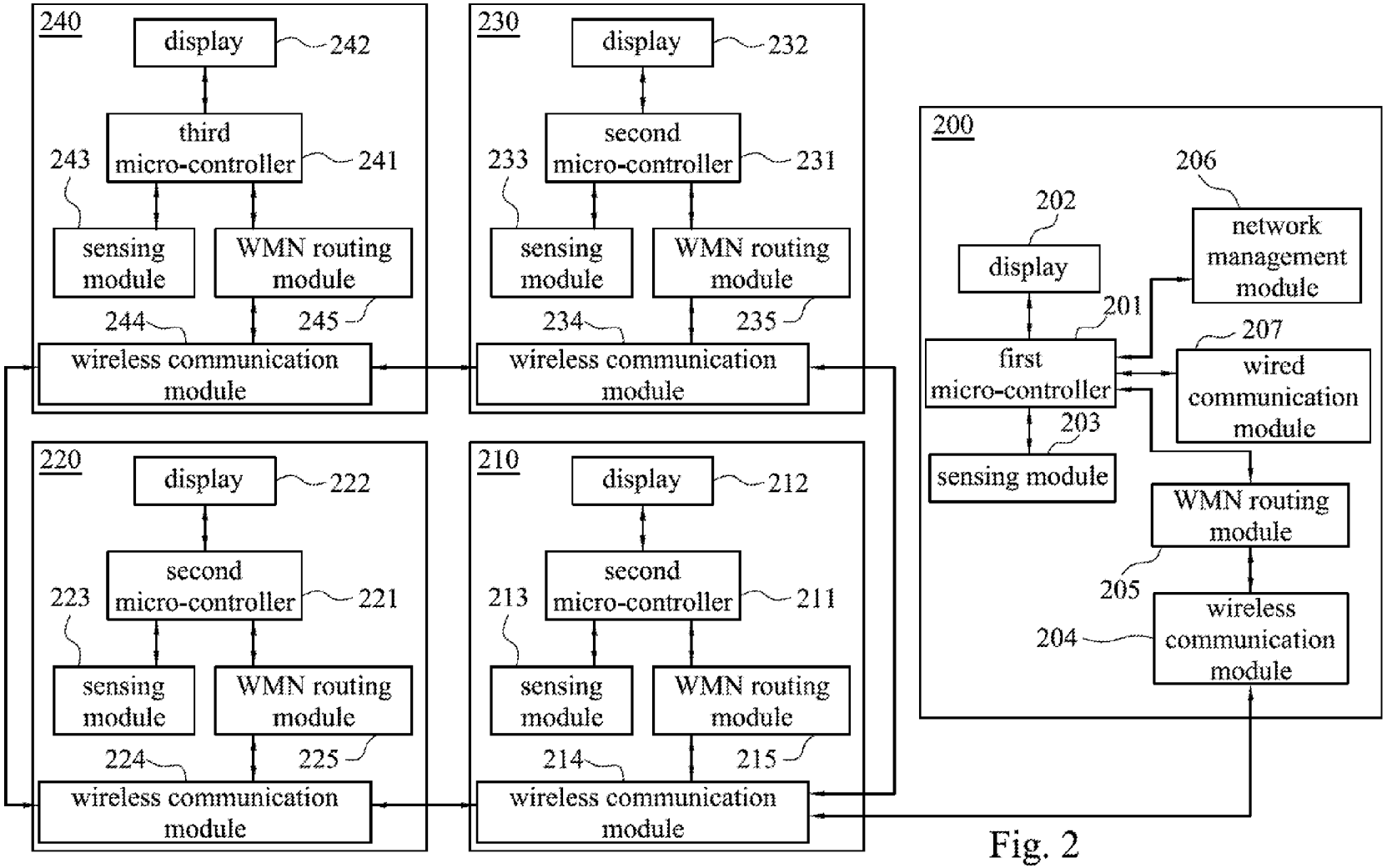
FIG. 2 illustrates a schematic diagram of a WMN communication system according to an embodiment of the invention.

FIG. 2 illustrates a schematic diagram of a WMN communication system according to an embodiment of the invention. In this embodiment, a WMN main station 200, three WMN relay stations and a WMN assistant station 240 are used to explain this invention. However, in another embodiment, the number of the WMN relay stations and the WMN assistant stations may be changed. The three WMN relay stations include a first WMN relay station 210, a second WMN relay station 220 and a third WMN relay station 230. The WMN main station 200 includes a first micro-controller 201, a display 202, a sensing module 203, a wireless communication module 204, a WMN routing module 205, a network management module 206 and a wired communication module 207. Each of the WMN relay stations 210, 220 and 230 has same structure that respective includes a second micro-controller 211, 221 and 231, a display 212, 222, and 232, a sensing module 213, 223 and 233, a wireless communication module 214, 224 and 234, and a WMN routing module 215, 225 and 235. The WMN assistant station 240 includes a third micro-controller 241, a display 242, a sensing module 243, a wireless communication module 244, and a WMN routing module 245. The sensing module 203, 213, 223, 233 and 243 are earthquake sensors, rainfall sensors, water stage sensors or water flow sensors. The sensing modules 203, 213, 223, 233 and 243 are electrically connected to the micro-controllers 201, 211, 221, 231 and 241 respectively. In another embodiment, the sensing modules 203, 213, 223, 233 and 243 are connected to the micro-controllers 201, 211, 221, 231 and 241 respectively through a communication protocol, such as the Modbus protocol. The displays 202, 212, 222, 232 and 242 are LCD displays or billboards. The wireless communication modules 204, 214, 224, 234 and 244 include wireless transceivers to transfer pre-warning information to other WMN devices. The wireless communication modules 204, 214, 224, 234 and 244 are Ultra High Frequency (UHF) communication modules or Very High Frequency (VHF) communication modules. The wireless communication modules 204, 214, 224, 234 and 244 have to support a WMN routing rule to ensure a reliable information communication. The communication range is determined according to the number of the WMN devices.

In this embodiment, the WMN main station 200, the three WMN relay stations 210, 220 and 230 and the WMN assistant station 240 have similar structure that include the micro-controller, the wireless communication module and the routing module. The display and the sensing module are selectively disposed in the WMN main station 200, the three WMN relay stations 210, 220 and 230 and the WMN assistant station 240. That is, if one of the WMN main station 200, the three WMN relay stations 210, 220 and 230 and the WMN assistant station 240 is only used to transfer the disaster information, it is not necessary to dispose the display and the sensing module thereon. Moreover, the displays 202, 212, 222, 232 and 242 in the claimed invention are used to inform the disaster information. However, in another embodiment, other warning apparatus, such as speakers, can also be used to inform the public.

The micro-controllers 201, 211, 221, 231 and 241 of the WMN main station 200, the three WMN relay stations 210, 220 and 230 and the WMN assistant station 240 are used to serve as main controllers. The routing modules 205, 215, 225, 235 and 245 couple with the micro-controllers 201, 211, 221, 231 and 241 respectively to determine the path of the disaster information from source to destination. The routing module 205, 215, 225, 235 and 245 send the path to the micro-controllers 201, 211, 221, 231 and 241 respectively. The wireless communication modules 204, 214, 224, 234 and 244 couple with the routing module 205, 215, 225, 235 and 245 to wireless transfer and receive the disaster information according to the control of the routing module 205, 215, 225, 235 and 245. The sensing modules 203, 213, 223, 233 and 243 couple with the micro-controllers 201, 211, 221, 231 and 241 respectively to detect a disaster data and transfer this data to the micro-controllers 201, 211, 221, 231 and 241 respectively. The displays 202, 212, 222, 232 and 242 couple with the micro-controllers 201, 211, 221, 231 and 241 respectively to display the sensing data from the sensing modules 203, 213, 223, 233 and 243, or the operation stat of the WMN device, or the pre-warning information. Moreover, because the WMN main station 200 is responsible to the logical arrangement and operating of the WMN, a network management module 206 is disposed in the WMN main station 200. On the other hand, an additional wired communication module 207 is also is disposed in the WMN main station 200 to insure that the WMN main station 200 may wired or wireless communicate with the monitoring host 101.

In this embodiment, all the WMN main station 200, the three WMN relay stations 210, 220 and 230 and the WMN assistant station 240 are used not only to transfer disaster information but also to sense the disaster data. Therefore, all the WMN main station 200, the three WMN relay stations 210, 220 and 230 and the WMN assistant station 240 are disposed sensing modules. Moreover, if all the WMN main station 200, the three WMN relay stations 210, 220 and 230 and the WMN assistant station 240 are required to inform the disaster information, all the WMN main station 200, the three WMN relay stations 210, 220 and 230 and the WMN assistant station 240 are disposed warning devices (not shown in the FIG. 2), such as speakers. In another embodiment, the three WMN relay stations 210, 220 and 230 and the WMN assistant station 240 are further disposed GPS devices (not shown in the FIG. 2) to collect the position data. Therefore, the WMN main station 200 may transfer the sensing data and the position data of the three WMN relay stations 210, 220 and 230 and the WMN assistant station 240 to the monitoring host 101. The monitoring host 101 may know the position of the disaster event happens. In another embodiment, the WMN main station 200, the three WMN relay stations 210, 220 and 230 and the WMN assistant station 240 are further disposed battery modules or electricity generators (not shown in the FIG. 2) to insure their normally operating during the power failure.

Accordingly, when the monitoring host 101 wants to acquire the data of the WMN main station 200, the three WMN relay stations 210, 220 and 230 and the WMN assistant station 240, the monitoring host 101 may send an acquiring to the WMN main station 200. Then, the network management module 206 of the WMN main station 200 may send the required data, such as the network connection state, the sensing module connection state or the reading data of the sensing module, of the WMN main station 200, the three WMN relay stations 210, 220 and 230 and the WMN assistant station 240 to the monitoring host 101 through the wired communication 207 or the wireless communication module 204. In an embodiment, the network management module 206 uses a network management protocol, such as a SNMP protocol, to manage this WMN.

On the other hand, the WMN main station 200 may require the disaster informing system 108 to transfer the latest disaster information through the wired communication 207 or the wireless communication module 204. The WMN main station 200 may also require the sensing data of the three WMN relay stations 210, 220 and 230 and the WMN assistant station 240 through the wireless communication module 204. The WMN main station 200 further requires the sensing data from the sensing module 203 of the WMN main station 200 through the first micro-controller 201. Then, the WMN main station 200 may integrate all the data to generate a pre-warning information according to a rule. The WMN main station 200 may inform the public the pre-warning information through the display 202. The WMN main station 200 may also send the pre-warning information to the monitoring host 101 to inform the mobile 107 of the public through the pre-warning message issuing host 105. On the other hand, if the pre-warning information is generated according to the latest disaster information that the WMN main station 200 requires the disaster informing system 108 through the wired communication 207 or the wireless communication module 204, the WMN main station 200 may transfer this pre-warning information to the wireless modules 214, 224, 234 and 244 of the three WMN relay stations 210, 220 and 230 and the WMN assistant station 240 through the wireless communication module 204. Then, the three WMN relay stations 210, 220 and 230 and the WMN assistant station 240 may inform this pre-warning information to the public through the displays 212, 222, 232, and 242.

On the other hand, after the three WMN relay stations 210, 220 and 230 and the WMN assistant station 240 receive the sensing data from the sensing modules 213, 223, 233 and 243, the three WMN relay stations 210, 220 and 230 and the WMN assistant station 240 may also generate a pre-warning information according to a rule. Then, the routing modules 215, 225, 235 and 245 of the three WMN relay stations 210, 220 and 230 and the WMN assistant station 240 may decide a best path to transfer this pre-warning information to the WMN main station 200. For example, when the WMN assistant station 240 receives the sensing data from its sensing module 243, the routing modules 245 may decide a best path, such as form the third WMN relay station 230 and the first WMN relay station 210 to transfer this pre-warning information to the WMN main station 200. The WMN main station 200 may send this pre-warning information to the monitoring host 101 to inform the mobile 107 of the public through the pre-warning message issuing host 105. In this embodiment, there are three WMN relay stations 210, 220 and 230. Therefore, even though the third WMN relay station 230 is failure, the routing modules 245 of the WMN assistant station 240 may change the path in real time to avoid the third WMN relay station 230, such as form the second WMN relay station 220 and the first WMN relay station 210 to transfer this pre-warning information to the WMN main station 200. Therefore, according to this embodiment, the communication quality and the communication reliable are improved.

Figure 3:
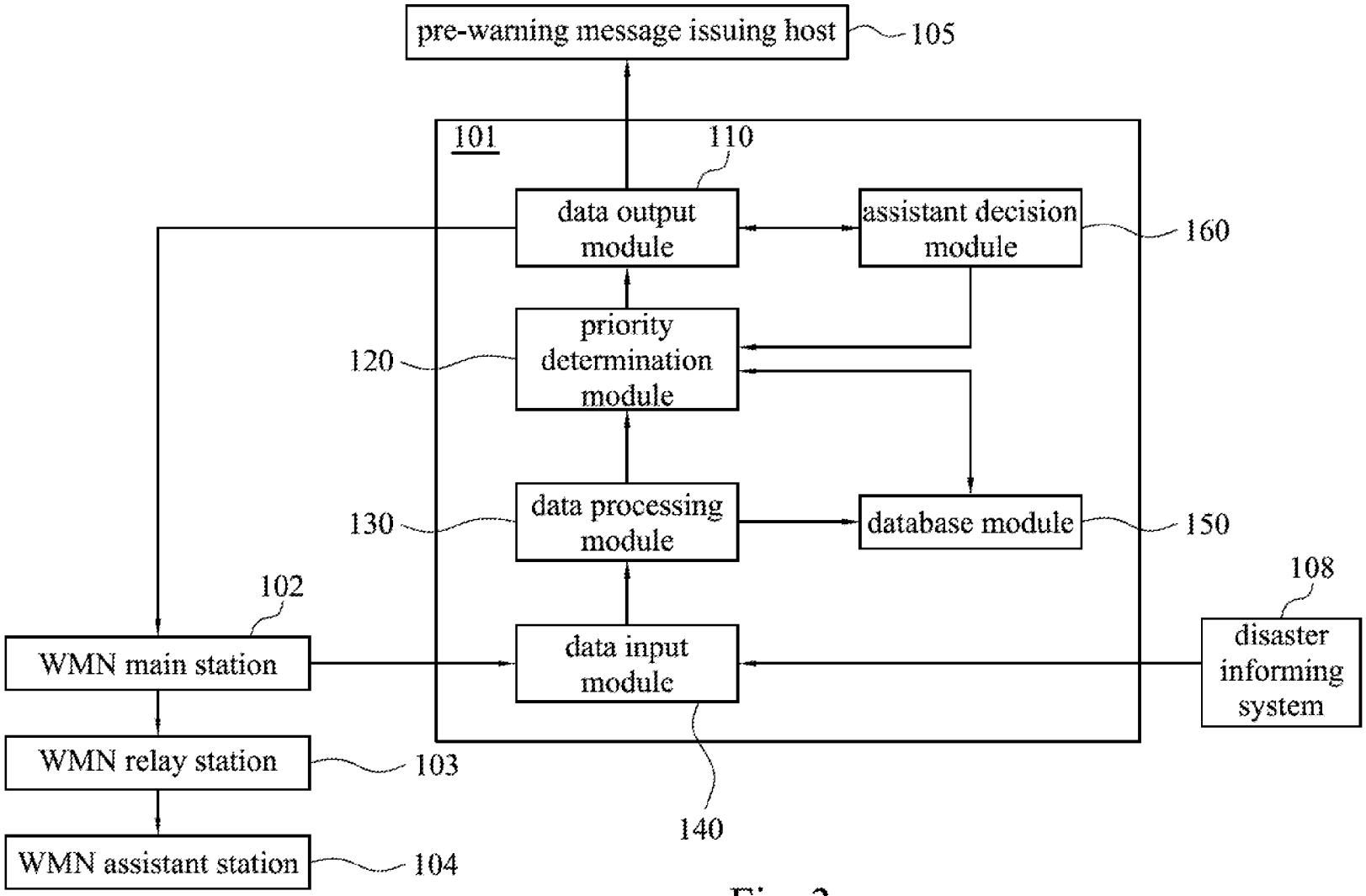
FIG. 3 illustrates a schematic diagram of a monitoring host according to an embodiment of the invention.

FIG. 3 illustrates a schematic diagram of a monitoring host according to an embodiment of the invention. Please refer to the FIG. 1 and FIG. 3. The monitoring host 101 provides a control interface to the operator to collect the disaster information that is transferred to the WMN main station 102 from the WMN relay stations 103 and WMN assistant stations 104, or to collect disaster information from the disaster informing system 108. Then, the monitoring host 101 may generate a pre-warning information according to a rule to inform the mobile 107 of the public through the pre-warning message issuing host 105. The disaster information collected from the WMN main station 102 is the onsite disaster information. The disaster information collected from the disaster informing system 108 is the regional disaster information. The monitoring host 101 integrates the two types of information, the onsite disaster information and the regional disaster information to generate a pre-warning information according to a rule to inform the mobile 107 of the public through the pre-warning message issuing host 105. Accordingly, the present invention can compensate the incomplete onsite disaster information due to only about one site and improve the reliable of the regional disaster information.

The monitoring host 101 includes a data output module 110, a priority determination module 120, a data processing module 130, a data input module 140, a database module 150 and an assistant decision module 160. The data input module 140 collects the data from the WMN main station 102 and the disaster informing system 108 to transfer to the data processing module 130 to process. Then, the data processing module 130 stores the processed data to the database module 150. Next, the priority determination module 120 determines the most urgent pre-warning information according an issuing rule to transfer to the data output module 110. Then, the data output module 110 outputs the pre-warning information to the pre-warning message issuing host 105 to inform the mobile 107 of the public. On the other hand, the data output module 110 may also output the pre-warning information to the WMN main station 102 to transfer to the WMN relay stations 103 and WMN assistant stations 104 to inform the public through displays thereon. The monitoring host 101 further comprises an assistant decision module 160 that can provide an additional data from the data output module 110 to assist the priority determination module 120 to rearrange the priority. For example, the assistant decision module 160 is an image monitor. In an embodiment, the data output module 110 outputs the rainfall data from the sensing module of the WMN relay stations 103 and WMN assistant stations 104. However, the rainfall data does not reach a threshold value to issue a pre-warning information. Therefore, no any pre-warning information is issued. At this time, because the assistant decision module 160 is an image monitor disposed closed to a river, the assistant decision module 160 can provide a real time image of the water stage data of this river to the priority determination module 120 to determine whether or not to rearrange the priority and to issue a pre-warning information.

The pre-warning message issuing host 105 may further provide a location based service (LBS) according to the GPS data transferred from the WMN relay stations 103 and the WMN assistant stations 104. That is, the pre-warning message issuing host 105 may issue a pre-warning information to inform the public according to the GPS data. For example, if P wave sensing modules disposed on the WMN relay stations 103 and the WMN assistant stations 104 sense earthquake information, the pre-warning message issuing host 105 issues a pre-warning information to inform the public according to the GPS data. A Short Message Service or an Application program, such as the skype or the line, is used to help the pre-warning message issuing host 105 to inform the public.

FIG. 4A and FIG. 4B illustrates a record table of a disaster event according to an embodiment of the invention. FIG. 4C illustrates a record table of a pre-warning threshold value according to an embodiment of the invention. The FIG. 4A and the FIG. 4B are stored in the database module 150. The data recorded in the record table is the data from the WMN relay stations 103 and the WMN assistant stations 104 transferred to the WMN main station 102, and the data from the disaster informing system 108. The record table has a plurality of fields including "the type of the disaster event", "the type of the sensing module", "the data content", "the time", "the latitude", "the longitude", "data source" and "whether or not the disaster information is a pre-warning information". In this embodiment, the monitoring host 101 may understand the importance of a disaster information according to the field of "whether or not the disaster information is a pre-warning information". In other words, if the field of "whether or not the disaster information is a pre-warning information" is "yes", which means the disaster information is a pre-warning information, the data output module 110 of the monitoring host 101 may immediately send this pre-warning information to the pre-warning message issuing host 105 to inform the public, or send this pre-warning information to the WMN relay stations 103 and the WMN assistant stations 104 to inform the public through the displays.

As shown in the FIG. 4A, the record table records a disaster information that includes the type of the disaster event is an earthquake event, the type of the sensing module is an earthquake sensor, the data content is an earthquake measuring 4 on the Richter scale that will happen after 4 second, the data source is a regional information, that is, the data is from the disaster informing system 108 and the disaster information is a pre-warning information, that is, this disaster information has been decided by an expert. Therefore, this disaster information has a top priority and has to be issued immediately. On the other hand, as shown in the FIG. 4B, the first disaster information in the record table records the type of the disaster event is a flood disaster, the data content is the rainfall measuring 50 mm, the data source is an onsite information, that is, the data is from the WMN main station 102, and the disaster information is not a pre-warning information, that is, this disaster information has not been decided by an expert. Therefore, this disaster information has to be compared with the threshold value as shown in FIG. 4C to determine whether or not to issue a pre-warning information. The threshold value in FIG. 4C may be got according to the history records of the onsite disaster information. For example, the relationship between the historical rainfall value, the historical water stage value or the historical water flow value and the flood disaster is used to build the threshold value in FIG. 4C.

Figure 5:
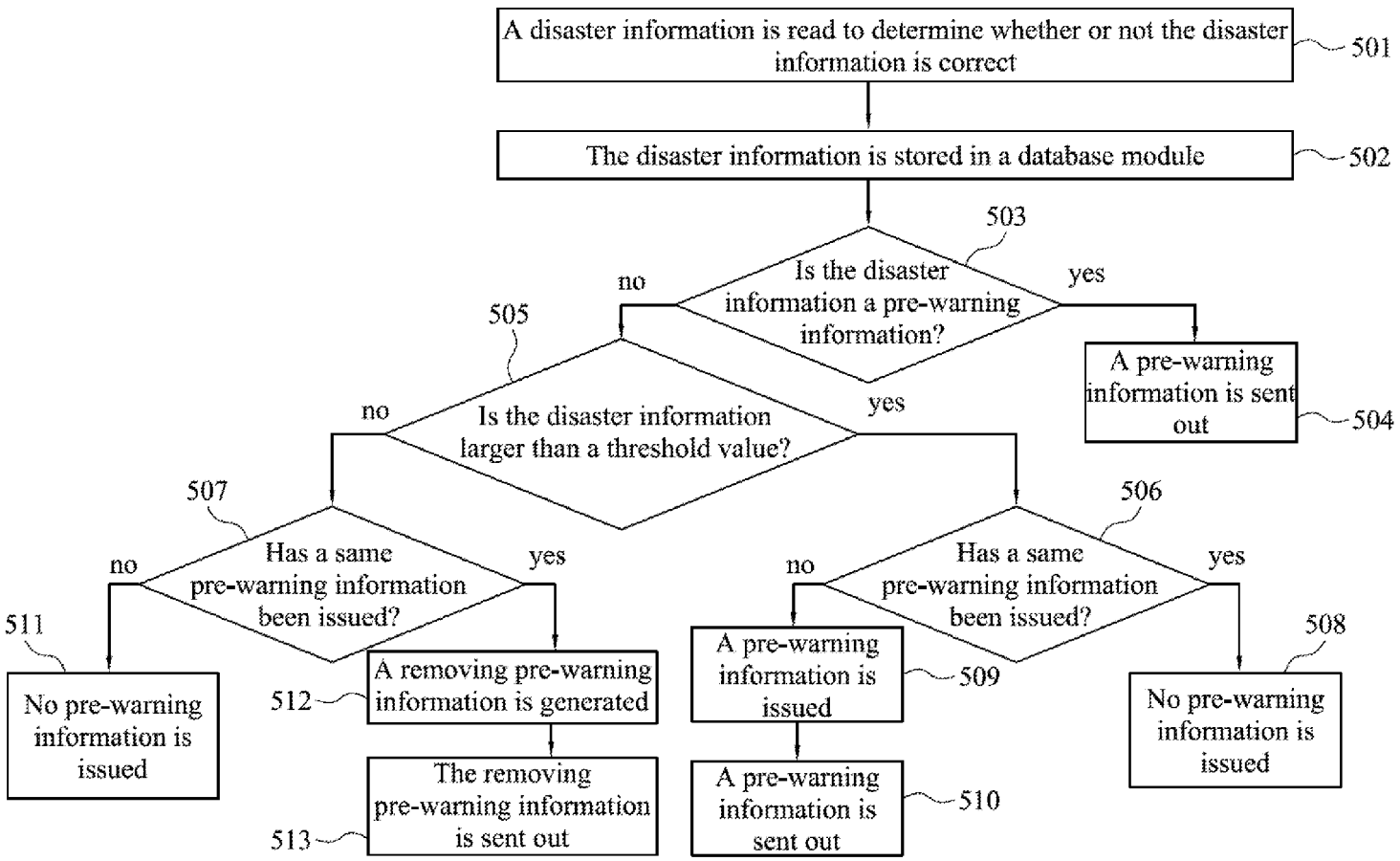
FIG. 5 illustrates a flow chart of a monitoring host to issue a pre-warning signal according to an embodiment of the invention.

FIG. 5 illustrates a flow chart of a monitoring host to issue a pre-warning signal according to an embodiment of the invention. Please refer to FIG. 3 and FIG. 5. In step 501, a disaster information is read to determine whether or not the disaster information is correct. In an embodiment, the disaster information is from the WMN relay stations 103 and the WMN assistant stations 104 transferring to the WMN main station 102, or from the disaster informing system 108. Then, a determination step is performed to determine whether or not the disaster information is correct, that is to determine whether or not the disaster information happens in a region monitored by the monitoring host 101. A disaster event happens in other region may cause another disaster event happens in this present region, such as an earthquake disaster event. However, if the other region is very far away from this present region, the possibility of a disaster event happens in this present region is very small even though a disaster event happens in other region. Therefore, the monitoring host 101 may generate a monitoring region according to a rule. If the disaster event does not happen in this monitoring region, this disaster event does not be processed by the monitoring host 101. That is, the disaster event will be ignored. If the disaster event happens in this monitoring region, the monitoring host 101 processes this disaster event.

In step 502, the disaster information is stored in the database module. In an embodiment, the data processing module 130 stores the disaster information in the database module 150. The data processing module 130 also sends the disaster information to the priority determination module 120.

In step 503, a determination step is performed to determine whether or not the disaster information is a pre-warning information. In an embodiment, the priority determination module 120 determines whether or not the disaster information is a pre-warning information. If the disaster information is a pre-warning information, which means this disaster information has been decided by an expert, the disaster information has to be sent out immediately. Accordingly, in step 504, a pre-warning information is sent out. In an embodiment, the monitoring host 101 generates a pre-warning information to the data output module 110. Then, the data output module 110 outputs the pre-warning information to the pre-warning message issuing host 105 to inform the mobile 107 of the public. On the other hand, the data output module 110 may also output the pre-warning information to the WMN main station 102 to transfer to the WMN relay stations 103 and WMN assistant stations 104 to inform the public through displays thereon. If the disaster information is not a pre-warning information, which means this disaster information has not been decided by an expert, the disaster information has to be further analyzed. Accordingly, in step 505, this disaster information is compared with a threshold value to determine whether or not to issue a pre-warning information. In an embodiment, this disaster information is compared with a threshold value recorded in a record table stored in the database module 150 to determine whether or not the sensing value of the disaster information is larger than the threshold value, and then to determine whether or not to issue a pre-warning information.

When the sensing value of the disaster information is larger than the threshold value, a step 506 is performed. In step 506, a determination step is performed to determine whether or not a same pre-warning information has been issued. In an embodiment, for reducing the number to issue the pre-warning information, a determination step is performed to determine whether or not a same pre-warning information has been issued. If a same pre-warning information has been issued, the pre-warning information does not be issued in step 508. If a same pre-warning information has not been issued, the pre-warning information is issued in step 509. Then, in step 510, the pre-warning information is sent out. In an embodiment, the monitoring host 101 generates a pre-warning information to the data output module 110. Then, the data output module 110 outputs the pre-warning information to the pre-warning message issuing host 105 to inform the mobile 107 of the public. On the other hand, the data output module 110 may also output the pre-warning information to the WMN main station 102 to transfer to the WMN relay stations 103 and WMN assistant stations 104 to inform the public through displays thereon.

When the sensing value of the disaster information is less than the threshold value, a step 507 is performed. In step 507, a determination step is performed to determine whether or not a same pre-warning information has been issued. In an embodiment, for reducing the number to issue the pre-warning information, a determination step is performed to determine whether or not a same pre-warning information has been issued. If no any same pre-warning information has been issued, which means there is no disaster event happens, a step 511 is performed. No any pre-warning information is issued in step 511. If a same pre-warning information has been issued, which means the disaster event is over, a step 512 is performed to generate a removing pre-warning information. Then, the removing pre-warning information is sent out is step 513. In an embodiment, the monitoring host 101 generates the removing pre-warning information to the data output module 110. Then, the data output module 110 outputs the removing pre-warning information to the pre-warning message issuing host 105 to inform the mobile 107 of the public. On the other hand, the data output module 110 may also output the removing pre-warning information to the WMN main station 102 to transfer to the WMN relay stations 103 and WMN assistant stations 104 to inform the public through displays thereon.

FIG. 6 illustrates a classification table of a pre-warning signal issued by a monitoring host according to an embodiment of the invention. The pre-warning information generated by the monitoring host 101 is further classified according to the type of the disaster event, the level of severity, the type of pre-warning and the reliability. Each classification has a specific identification code. In an embodiment, each pre-warning information is embedded a specific identification code. The specific identification code is arranged in the header of the packet or the string. Therefore, when the WMN device receives a pre-warning information, the importance of the pre-warning information may be notified by analyzing the identification code arranged in the header. In an embodiment, the specific identification code of a pre-warning information is 333. As shown in the FIG. 6, the level of severity of a disaster is high-level, the type of pre-warning is that the disaster will happen, and the reliability has been confirmed by an expert. Accordingly, this pre-warning information has to be sent out immediately. In another embodiment, the specific identification code of a pre-warning information is 221. As shown in the FIG. 6, the level of severity of a disaster is middle-level, the type of pre-warning is that the disaster has happened, and the reliability has not been confirmed by an expert. In other words, the pre-warning information is from the WMN main station 102, the WMN relay stations 103 and WMN assistant stations 104. Therefore, when the monitoring host 101 receives the foregoing two pre-warning information at the same time, the pre-warning information with specific identification code of 333 has a high priority and will be sent out first.

On the other hand, all the WMN main station 102, the WMN relay stations 103 and WMN assistant stations 104 have micro-controllers. The record table of the FIG. 4C is disposed in the WMN main station 102, the WMN relay stations 103 and WMN assistant stations 104 respectively. Accordingly, all the WMN main station 102, the WMN relay stations 103 and WMN assistant stations 104 may determine whether or not the sensing values sensed by their sensing modules are larger than threshold values according to the record table by themselves. Therefore, the WMN main station 102, the WMN relay stations 103 and WMN assistant stations 104 may issue the pre-warning information in the displays immediately when the sensing values are larger than threshold values. That is, the WMN main station 102, the WMN relay stations 103 and WMN assistant stations 104 may perform the step 505 to step 513 as shown in the FIG. 5 to determine whether or not to issue a pre-warning information. However, because the sensing values of the WMN main station 102, the WMN relay stations 103 and WMN assistant stations 104 do not be confirmed by an expert, the priority of the pre-warning information of the monitoring host 101 is higher than that of the WMN main station 102, the WMN relay stations 103 and WMN assistant stations 104. Therefore, the problem of sending out same pre-warning information repeatedly is avoided. Moreover, the frequency of the monitoring host 101 requiring data from the WMN main station 102 is automatically reduced after the pre-warning information has been sent out for saving the bandwidth. In an embodiment, the pre-warning information is graded. The first grad pre-warning information is the most serious. Therefore, before the first grad pre-warning information is sent out, the frequency of the monitoring host 101 requiring data from the WMN main station 102 is automatically increased. For example, when the disaster is a flood disaster, the frequency is increased according to the water stage. Once the first grad pre-warning information is sent out, the frequency of the monitoring host 101 requiring data from the WMN main station 102 is automatically reduced.

Accordingly, the disaster monitoring and pre-warning system may integrate onsite disaster information and regional disaster information. The monitoring host may integrate the regional disaster information into onsite disaster information to provide a complete disaster information. Moreover, the onsite disaster information is transferred in a WMN structure. In a WMN structure, each WMN device has transferring and receiving function. The packet from a WMN device can be passed by another WMN device. Therefore, the transferring range is enlarged. On the other hand, the WMN structure provides multiple communication paths between a WMN device and another WMN device. In other words, even though a WMN device in a communication path is failure, the packet original transferred in the communication path may be changed to transfer through another communication path. Therefore, the communication stability may be improved.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A disaster monitoring and pre-warning system, comprising:

a disaster informing system for transferring at least one first disaster information;

a plurality of Wireless Mesh Network (WMN) devices for sensing at least one disaster event to generate at least one second disaster information according to the at least one disaster event, wherein the at least one second disaster information is transferred by a peer-to-peer technology;

a monitoring host for receiving the at least one first disaster information and the at least one second disaster information, wherein each of the at least one first disaster information and each of the at least one second disaster information further comprise a data of the at least one disaster event and a data of whether or not the at least one disaster event is a pre-warning event, and the monitoring host generates a first pre-warning information according to the pre-warning event when one of the at least one first disaster information and the at least one second disaster information includes the data of the at least one disaster event is the pre-warning event; and a pre-warning message issuing host to issue the first pre-warning information, wherein the Wireless Mesh Network (WMN) devices further comprises:

a plurality of WMN assistant stations for sensing the at least one disaster event to generate the at least one second disaster information:

a plurality of WMN relay stations for receiving the at least one second disaster information and pass the at least one second disaster information; and a WMN main station for receiving the at least one second disaster information from the WMN relay stations and the at least one first disaster information or the first pre-warning information from the monitoring host, wherein the WMN main station further comprises:

a first communication module for communicating with the WMN relay stations to receive the at least one second disaster information;

a second communication module for communicating with the monitoring host to receive the first pre-warning information;

a first micro-controller for receiving the first pre-warning information and receiving the at least one second disaster information to generate a second pre-warning information, wherein when the first micro-controller receives the first pre-warning information and the at least one second disaster information at the same time, the first micro-controller transfers the first pre-warning information first.

2. The disaster monitoring and pre-warning system of claim 1, wherein the WMN main station further comprises:

a display for displaying the first pre-warning information or the second pre-warning information from the first micro-controller.

3. The disaster monitoring and pre-warning system of claim 1, wherein the WMN main station further comprises:

a network management module, wherein the WMN main station can provide data of the WMN assistant stations and WMN relay stations to the monitoring host through the network management module.

4. The disaster monitoring and pre-warning system of claim 1, wherein the WMN main station further comprises:

a sensing module for sensing at least one disaster event.

5. The disaster monitoring and pre-warning system of claim 1, wherein each of the WMN relay stations further comprises:

a third communication module for communicating with the other WMN relay stations, the WMN main station and the WMN assistant stations to transfer the at least one second disaster information; and a second micro-controller for receiving the first pre-warning information and receiving the at least one second disaster information to generate a second pre-warning information, wherein when the second micro-controller receives the first pre-warning information and the at least one second disaster information at the same time, the second micro-controller transfers the first pre-warning information first.

6. The disaster monitoring and pre-warning system of claim 5, wherein each of the WMN relay stations further comprises:

a display for displaying the first pre-warning information or the second pre-warning information from the second micro-controller.

7. The disaster monitoring and pre-warning system of claim 5, wherein each of the WMN relay stations further comprises:

a sensing module for sensing at least one disaster event.

8. The disaster monitoring and pre-warning system of claim 1, wherein each of the WMN assistant stations further comprises:

a sensing module for sensing at least one disaster event to generate the at least one second disaster information according to the at least one disaster event;

a fourth communication module for communicating with the WMN relay stations and the WMN main station to transfer the at least one second disaster information; and a third micro-controller for receiving the first pre-warning information and receiving the at least one second disaster information to generate a second pre-warning information, wherein when the third micro-controller receives the first pre-warning information and the at least one second disaster information at the same time, the third micro-controller transfers the first pre-warning information first.

9. The disaster monitoring and pre-warning system of claim 8, wherein each of the WMN assistant stations further comprises:

a display for displaying the first pre-warning information or the second pre-warning information from the third micro-controller.

10. The disaster monitoring and pre-warning system of claim 1, wherein the monitoring host further comprises:

a data input module for receiving the at least one first disaster information and the at least one second disaster information;

a data processing module for storing the at least one first disaster information and the at least one second disaster information to a database module;

a priority determination module for comparing the at least one first disaster information and the at least one second disaster information with a pre-warning rule to generate the first pre-warning information; and a data output module for transferring the first pre-warning information to the pre-warning message issuing host and the WMN main station.

11. A disaster monitoring and pre-warning method, comprising:

receiving a disaster information by a monitoring host, wherein the disaster information further comprise a data of whether or not the disaster information is a pre-warning event, wherein the disaster information comprises at least one first disaster information from a disaster informing system and at least one second disaster information from a plurality of Wireless Mesh Network (WMN) devices;

determining whether or not the disaster information is a pre-warning event according to the data;

generating a pre-warning information when the data indicates that the disaster information is the pre-warning event;

comparing a pre-warning value of the disaster information with a pre-warning threshold value when the data indicates that the disaster information is not the pre-warning event;

determining whether or not a pre-warning information about the disaster information has been issued when the pre-warning value of the disaster information is larger than the pre-warning threshold value and when the data indicates that the disaster information is not the pre-warning event; and issuing the pre-warning information about the disaster information when the pre-warning information about the disaster information has not been issued, wherein the Wireless Mesh Network (WMN) devices further comprises:

a plurality of WMN assistant stations for sensing at least one disaster event to generate the at least one second disaster information;

a plurality of WMN relay stations for receiving the at least one second disaster information and pass the at least one second disaster information; and a WMN main station for receiving the at least one second disaster information from the WMN relay stations and the at least one first disaster information or the pre-warning information from the monitoring host, wherein the WMN main station further comprises:

a first communication module for communicating with the WMN relay stations to receive the at least one second disaster information;

a second communication module for communicating with the monitoring host to receive the pre-warning information;

a first micro-controller for receiving the pre warning information and receiving the at least one second disaster information to generate a second pre-warning information, wherein when the first micro-controller receives the pre-warning information and the at least one second disaster information at the same time, the first micro-controller transfers the pre-warning information first.

12. The disaster monitoring and pre-warning method of claim 11, further comprising not to issue the pre-warning information when the pre-warning information has been issued.

13. The disaster monitoring and pre-warning method of claim 11, further comprising:

determining whether or not a pre-warning information has been issued when the pre-warning value is less than the pre-warning threshold value; and issuing a removing information to remove the pre-warning information when the pre-warning information has been issued.

14. The disaster monitoring and pre-warning method of claim 13, further comprising not to issue any information about the disaster information when the pre-warning information has not been issued.

* * * * *